US005749188A

United States Patent [19]

Belbenoit

[11] Patent Number: 5,749,188

[45] Date of Patent: May 12, 1998

[54] RAISED FLOOR WITH MODULAR SLABS

[76] Inventor: Maurice Belbenoit, 45, avenue du General de Gaulle, Villeneuve-sur-Yonne, 89500, France

[21] Appl. No.: 525,657

[22] PCT Filed: Mar. 30, 1994

[86] PCT No.: PCT/FR94/00356

§ 371 Date: Sep. 29, 1995

§ 102(e) Date: Sep. 29, 1995

[87] PCT Pub. No.: WO94/23152

PCT Pub. Date: Oct. 13, 1994

[30] Foreign Application Priority Data

Mar. 31, 1993 [FR] France ..... 93 03757
Mar. 31, 1993 [FR] France ..... 93 03758

[51] Int. Cl.[6] ..... E04B 5/43

[52] U.S. Cl. ..... 52/263; 52/126.6; 52/650.3

[58] Field of Search ..... 52/263, 126.6, 52/650.3, 126.1, 126.5

[56] References Cited

U.S. PATENT DOCUMENTS

| | | | |
|---|---|---|---|
| Re. 35,369 | 11/1996 | Ducroux et al. | 52/263 X |
| 4,035,967 | 7/1977 | Harvey | 52/263 X |
| 4,198,795 | 4/1980 | Barnidge . | |
| 4,571,200 | 2/1986 | Serna | 52/263 X |
| 4,676,036 | 6/1987 | Bessert | 52/263 X |
| 4,709,519 | 12/1987 | Liefer et al. | 52/263 X |
| 4,850,163 | 7/1989 | Kobayashi et al. . | |
| 4,914,881 | 4/1990 | Spork . | |
| 4,996,804 | 3/1991 | Naka et al. . | |
| 5,052,157 | 10/1991 | Ducroux et al. . | |
| 5,483,776 | 1/1996 | Poppe | 52/263 X |

FOREIGN PATENT DOCUMENTS

| | | |
|---|---|---|
| 586145 | 2/1989 | Australia . |
| 0115475 | 8/1984 | European Pat. Off. . |
| 0398547 | 11/1990 | European Pat. Off. . |
| 643767 | 9/1928 | France . |
| 2501758 | 9/1982 | France . |
| 2564509 | 11/1985 | France . |
| 2107898 | 9/1971 | Germany . |
| 1335829 | 10/1973 | United Kingdom . |
| 2227763 | 8/1990 | United Kingdom . |
| WO85/05397 | 12/1985 | WIPO . |
| WO87/04210 | 7/1987 | WIPO . |

*Primary Examiner*—Christopher Kent
*Attorney, Agent, or Firm*—Greenblum & Bernstein P.L.C.

[57] ABSTRACT

A raised floor having an upper surface in the form of regular polygon-shaped modular slabs, each having a substantially horizontal plate portion and downwardly extending side edges. The plate portion of each slab is supported on the top of substantially vertical ground-engaging supports. Around the periphery of a top member of each vertical support are a plurality of radial slots for receiving pairs of confronting side edges of adjacent slabs for securing the slabs to the supports.

21 Claims, 5 Drawing Sheets

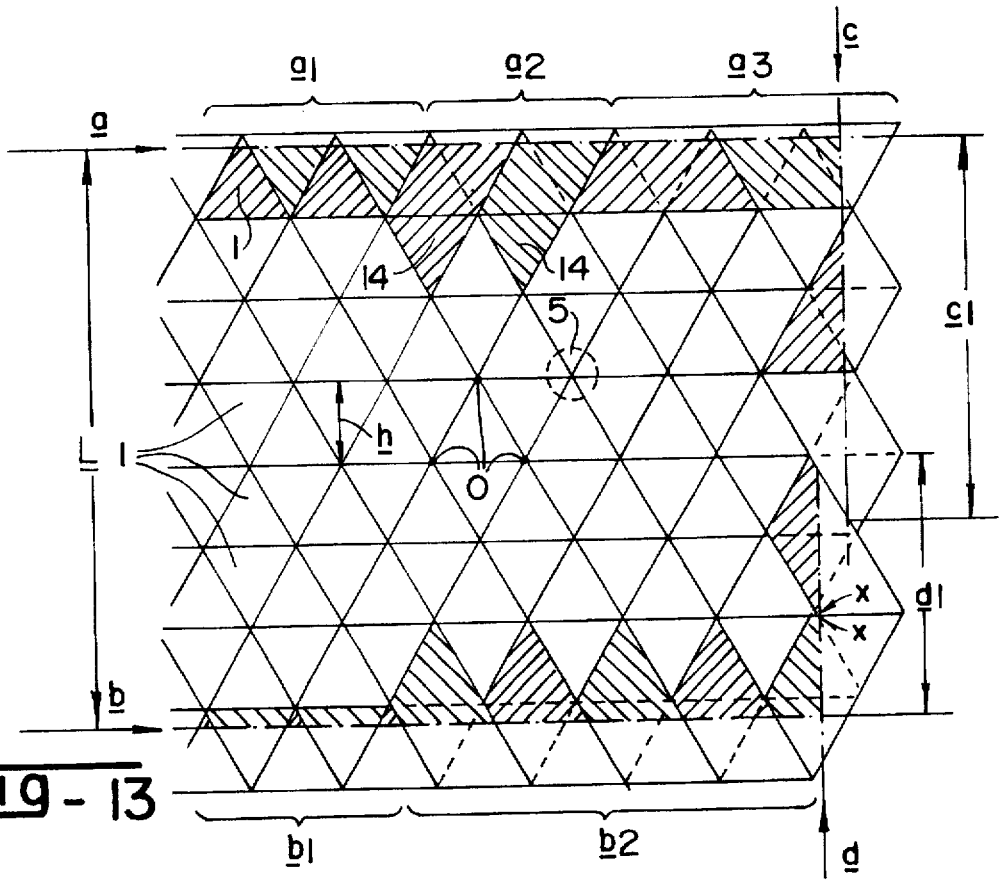
Fig - 13
Fig - 14
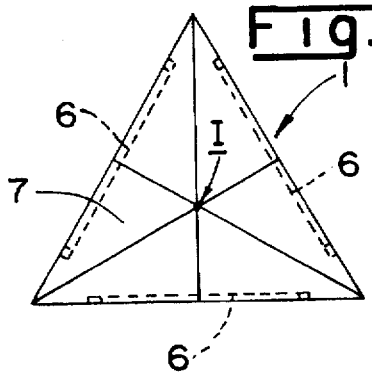
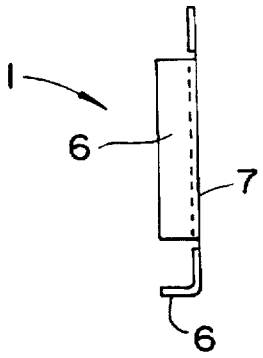
Fig - 15
Fig - 16
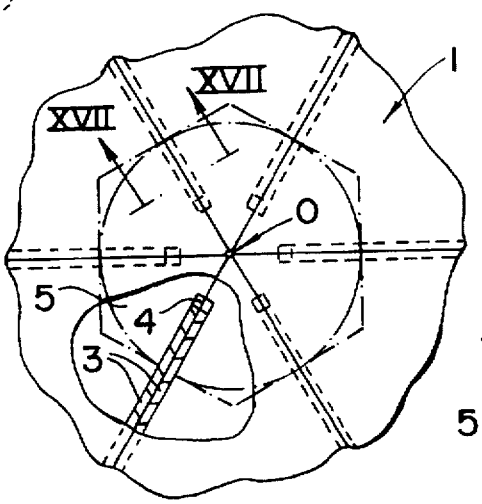
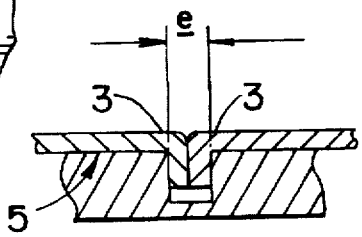
Fig - 17

Fig- 18
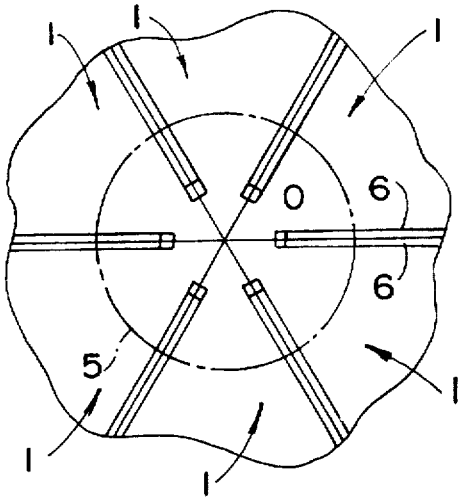
Fig- 19
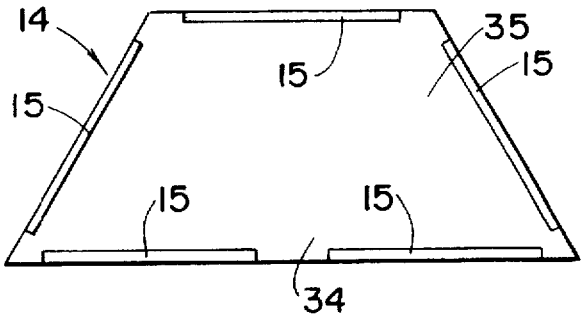
Fig- 20
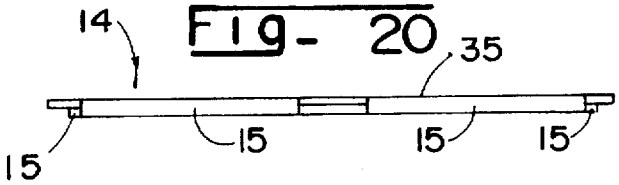
Fig- 21
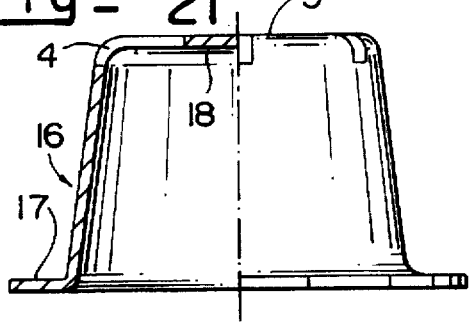
Fig- 22
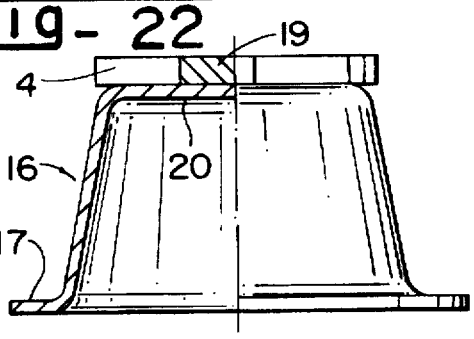
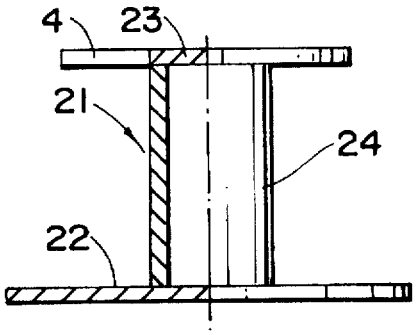
Fig-24
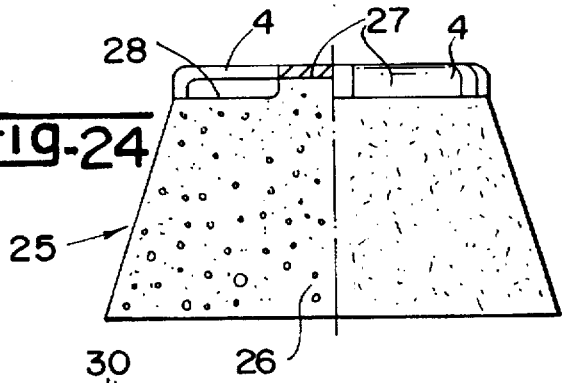
Fig- 23
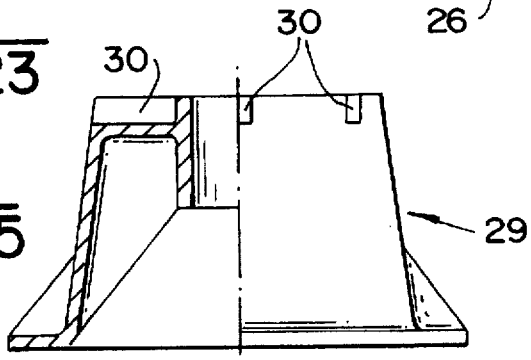
Fig- 25

RAISED FLOOR WITH MODULAR SLABS

BACKGROUND OF THE INVENTION

1. Field of the Invention

This invention relates to a raised floor made up of modular slabs mounted on vertical supports which are separated from each other and which rest on the ground.

2. Discussion of Background and Relevant Information

Raised floors known today are constituted of modular, usually square, slabs which are attached to one another in a horizontal plane and whose tops rest on horizontal supporting plates made up of the upper horizontal heads of vertical supports separated from each other. Each of these supports comprises a lower base fixed to the ground and a vertical bonding element, of fixed or adjustable length, between the lower base fixed to the ground and the upper support head of the slabs.

Up to the present time, slab tops have usually been placed quite simply on the upper support head of each support, their position on said head being determined by upwardly projecting elements held by the upper head of the support. These projecting elements are generally constituted of splinters which, in the case of square or rectangular slabs, are placed at regular intervals at right angles to each other around the vertical support axis, on which said axis the tops of four adjacent slabs merge. The splinters are inserted loosely in demarcated intervals between the lower parts of the slab edges in such a way that the assembly of the adjacent slabs on the support is relatively loose and the resulting floor is therefore not perfectly stabilized.

Another type of known raised floor assembly consists of supports whose heads possess slots into which the edges of the modular slabs are fitted, but the assembly of the adjacent slabs on the support obtained according to this process is also relatively loose, because a certain amount of play needs to be maintained for the purpose of fitting the edges of the slabs into the slots of the supports in order to facilitate assembly and to compensate for any expansion of the slabs. A known example of such an assembly is given in the context of U.S. Pat. No. 5,052,157 filed under the name of DUCROUX et al; another example is constituted by the floor described in German Patent Publication No. 2,107,898 filed under the name of CENTRAL FLOORING LTD. in which the support heads possess a protuberance against which the truncated tops of the slabs rest. Although the amount of play may be reduced in such an assembly, it cannot be completely eliminated for fear of raising the slabs in the event of expansion.

SUMMARY OF THE INVENTION

This invention aims to remedy the disadvantages described above by providing a slab assembly device ensuring a firm hold on these slabs once they are fixed on the upper heads of their supports. For this purpose, the raised floor, whose surface consists exclusively of modular slabs 1 in the shape of a regular polygon, presenting along their sides vertical edges 6 perpendicular to the plate 7 forming the base surface of said slabs 1, sustained at their tops by vertical supports 2 resting on the ground, is characterized in that the upper head 5 of the vertical supports 2 is fitted with radial slots 4 which are usually rectangular and which terminate in the periphery of said upper head 5, the width of said radial slots 4 being so determined as to cause a tightening through vertical fitting into a radial slot 4 of the vertical edges 6, facing each other, said vertical edges 6 belonging to two adjacent slabs 1.

BRIEF DESCRIPTION OF THE DRAWINGS

Non-limitative examples of various embodiments of the invention will now be described with reference to the accompanying drawings in which:

FIG. 13 is a plan view of a raised floor according to a variant of the invention in which the slabs are in the shape of an equilateral triangle.

FIG. 14 is a plan view of a floor slab made of sheet metal cut and folded into the form of an equilateral triangle.

FIG. 15 is a side-face view of the slab in FIG. 14 as seen from the left of the figure.

FIG. 16 is a larger-scale, partially cross-sectional, plan view of the zone in which six adjacent triangular slabs are attached to a common support.

FIG. 17 is a partial vertical section view along line XVII—XVII of FIG. 16.

FIG. 18 is a bottom view of the six adjoining slabs represented in FIG. 16.

FIG. 19 is a bottom view of an end slab made of sheet metal cut and folded into the shape of an isosceles trapezium.

FIG. 20 is a side-face view of the end slab represented in FIG. 19.

FIGS. 21, 22, 23, 24, 25 and 26 are front and axial section half-views of various embodiments of fixed-height triangular slab supports.

DETAILED DESCRIPTION OF THE PREFERRED EMBODIMENTS

Figure 1:
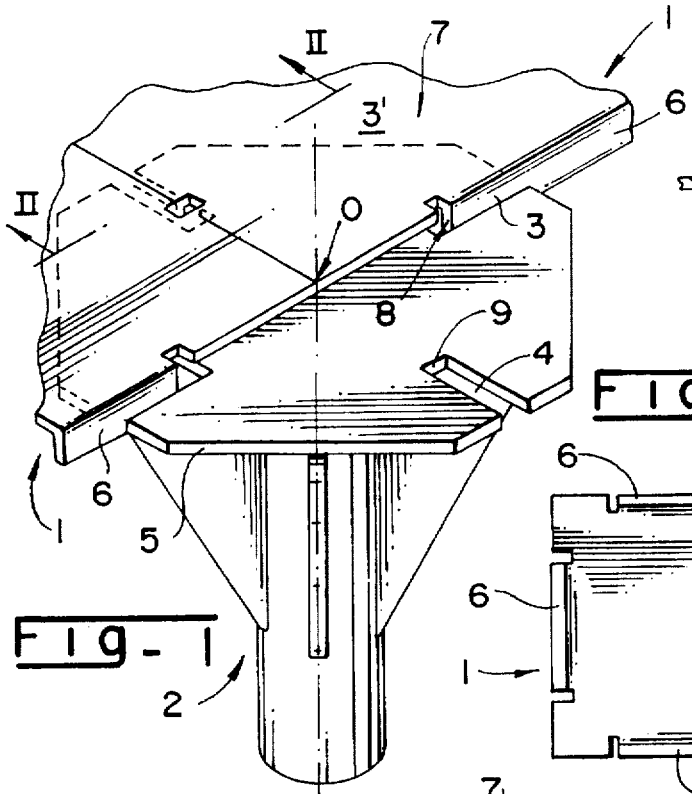
FIG. 1 is a perspective view of the assembly device according to the invention ensuring the maintenance of the square or rectangular slabs on a common support designed to hold four slabs.
Figure 2:
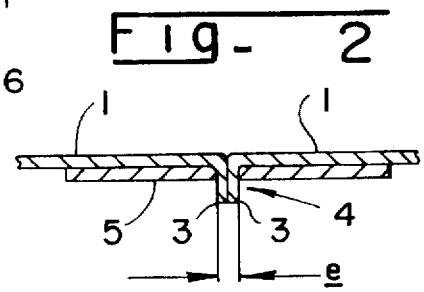
FIG. 2 is a vertical section view along line II—II of FIG. 1.
Figure 3:
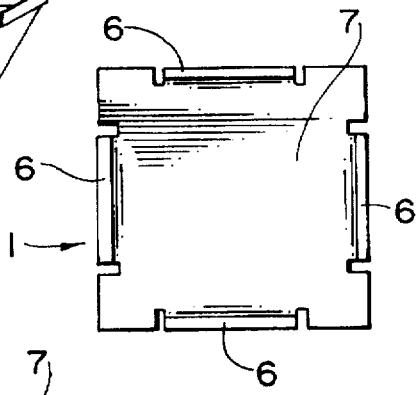
FIG. 3 is a plan view of a square-shaped floor slab.

The assembly device represented in FIGS. 1 to 3 is designed to ensure the maintenance of horizontal modular slabs 1, square or rectangular, of a raised floor on vertical supports 2 resting on the ground on which the raised floor is to be mounted. These vertical supports 2 are separated from each other by a distance corresponding to the dimensions of the modular slabs 1. Each vertical support 2, of fixed or adjustable height, comprises, on its lower part, a ground support base, not represented in the drawing, and, on its upper end, a horizontal support head 5 on which the tops of modular slabs 1 rest. In FIG. 1, only two slabs are partially represented, but it is clear that each vertical support 2 serves to support four square or rectangular slabs 1. These four slabs 1 are attached to each other, that is to say that their vertical edges 6 are fixed against each other, and the tops of the four adjacent slabs are merged together, as seen from a plan view in point O through which the vertical axis zz' of the support 2 passes.

According to the invention, the width of the rectangular slots 4, fitted on the upper head 5 of vertical supports 2 and terminating in its periphery, is so determined as to cause a tightening of vertical edges 6, facing each other, when said vertical edges 6, belonging to two adjacent slabs 1 are fitted vertically into a radial slot 4.

Figure 4:
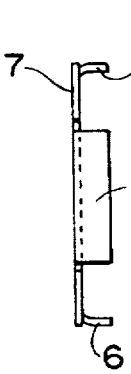
FIG. 4 is a side-face view of the slab in FIG. 3 as seen from the left of this figure.

FIGS. 3 and 4 represent a variant of square-shaped modular slabs according to which the edge 6 of said slab spreads horizontally over a length which is less than that of a side of the slab, being centered on the middle of the side.

Figure 5:
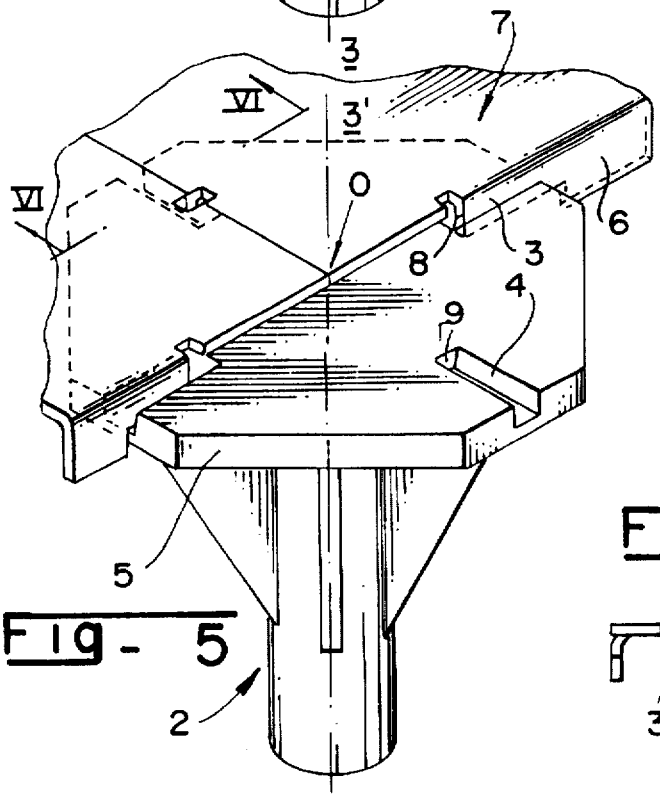
FIG. 5 is a perspective view of a variant embodiment of the square or rectangular slab assembly device.
Figure 6:
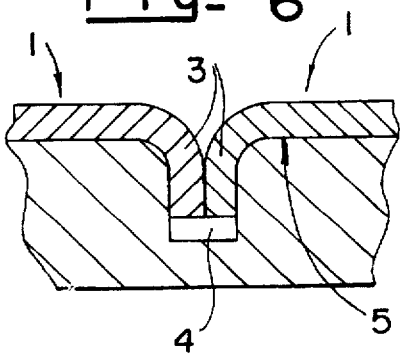
FIG. 6 is a vertical section view along line VI—VI of FIG. 5.

FIGS. 5 and 6 represent a slab assembly device according to another variant. In FIGS. 5 and 6, each edge 6 of a square or rectangular-shaped slab 1 is formed by a lateral rim, folded at right angles towards the bottom of the upper plate or plate portion 7 of slab 1. This edge 6 extends over a part of the length of the side of the slab, terminates at a distance from the top O of the slab and is extended towards this top for a short distance by a vertical joining edge of lesser height constituting a locking element of the slab 1 on the upper horizontal head 5 of a vertical support 2. For this purpose, the head 5 possesses four rectangular radial slots 4, terminating in the periphery of the circular or polygonal head 5, converging towards the center O and distributed regularly at right angles to each other around the vertical axis zz' of the support 2. Each locking slot 4 is rectangular in shape and its width e is equal, in the case of edges without bosses, to twice the thickness of a joining edge 3 of reduced height. The radial depths, and according to axis zz' of each slot 4, are sufficient to receive the whole of the joining edge 3, thereby allowing the corner of the slab 1 to rest on the central part of head 5 without there being contact between the vertical slices 8 of the parts 3 of the edges 6 ensuring the joining of slabs 1 and the vertical bottom 9 of the slots 4.

As may be seen from a study of FIG. 6, the adjacent slabs 1 are firmly secured on the head 5 of the support 2 by their joining edges 6 which are inserted tightly in their locking slots 4 and are held close to each other due to the fact that the thickness e of each slot 4 is equal to twice the thickness of the edges 6.

Figure 7:
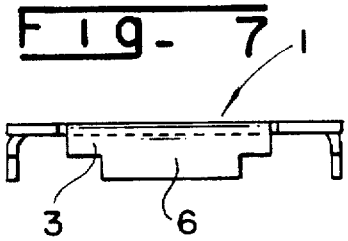
FIG. 7 is a side-face view of a slab according to a variant embodiment of the raised floor.

FIG. 7 is a side-face view of the slabs represented in FIGS. 5 and 6.

Figure 8:
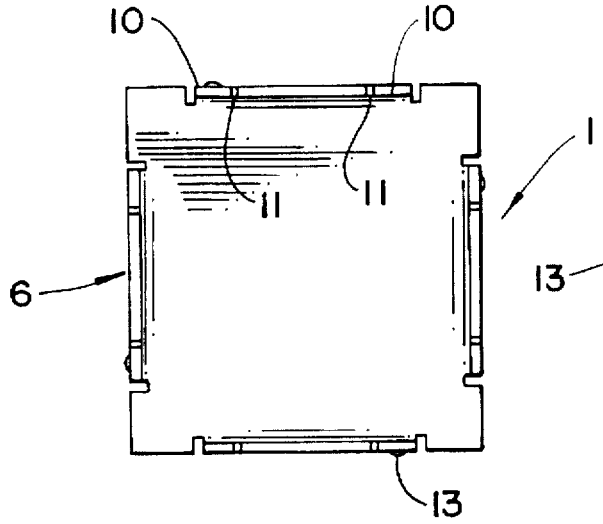
FIG. 8 is a plan view of a square-shaped slab of the floor according to a variant embodiment of the raised floor.
Figure 9:
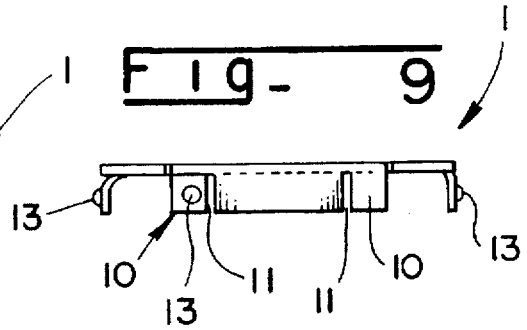
FIG. 9 is a side-face view of the slab in FIG. 8 as seen from the left of this figure.
Figure 11A:
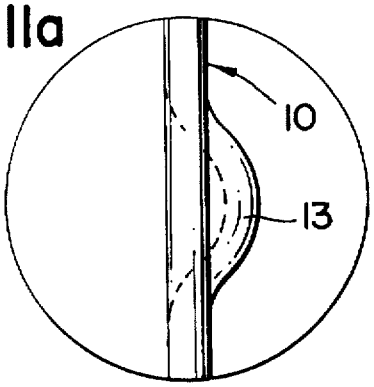
FIG. 11*a* shows a portion of FIG. 11 in greater detail.
Figure 10:
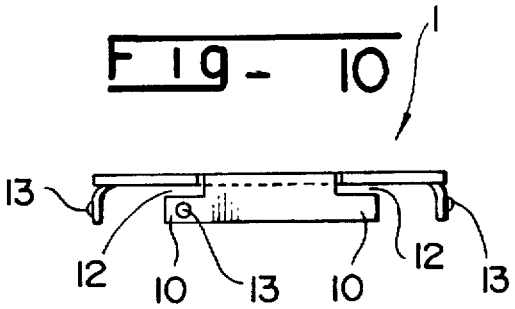
FIG. 10 represents a view similar to that of FIG. 9 according to another variant of the slab.
Figure 11:
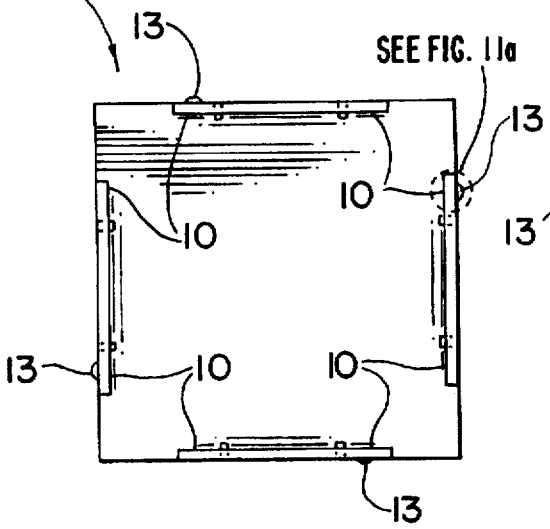
FIGS. 11 and 12 are plan views of a floor of a square-shaped slab of the floor presenting the two possible forms of dividing the bosses on the slab edges.
Figure 12:
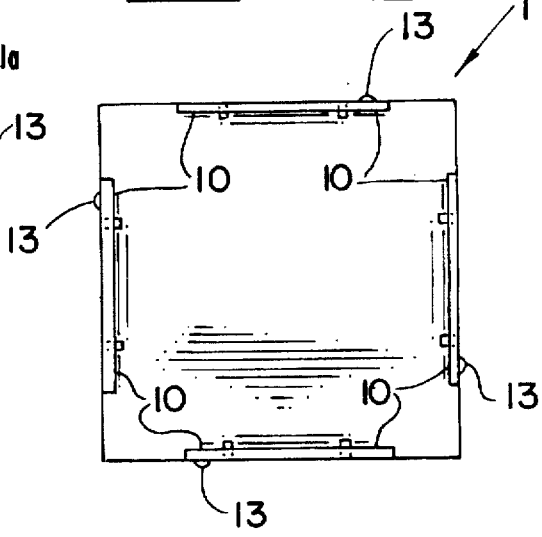

FIGS. 8, 9 and 10 illustrate a variant embodiment of the slabs according to the invention in which the end 3 of the edge 6 ensuring the fastening of each slab 1 in a radial slot 4 is made up of an elastic strip 10 which is obtained by means of a vertical cut 11 or horizontal cut 12 in the edge 6. In these same figures, a boss 13, shown in greater detail in FIG. 11*a*, is represented on half of the elastic strips, this boss corresponding to another embodiment of the slabs. According to this variant, one elastic strip in two is fitted with a boss 13 according to the distribution illustrated in FIGS. 11 and 12. These figures represent, in the case of square slabs, the two possible distributions of the bosses allowing the assembly of the slabs according to the invention. It is obvious that the shape of the slabs is not limitative and that the same results would be achieved with triangular or hexagonal slabs. The purpose of the elastic strips 10 is to make it possible to fix the slabs on the supports, this fixture presenting a certain elasticity, due to the strips, whilst at the same time maintaining a tight assembly of said strips 10 in the slots 4 provided on the heads 5 of the supports. Moreover, the addition of a boss on one of the two strips facing towards the interior of a slot 4 makes it possible to create a certain play between the surfaces 7 of the corresponding adjacent slabs. This illustrates how elastic strips fitted with bosses preserve play between the surfaces of the slabs which may therefore expand, for example as the result of heat, without this expansion causing the slabs to rise, even if the expansion of one or more slabs is greater than the play between the same slabs, the elasticity of the assembly allowing a relative movement of the slabs with regard to their support in the horizontal plane without causing upheaval phenomena. In addition, the slabs 1 will firmly fit onto their support 2 by means of the tight assembly of the strips in the slots 4. The result is a floor on which the two kinds of play have been disassociated. The play concerning the slots is eliminated thereby allowing a firm assembly of the edges 6 of the slabs 1 in the radial slots 4. The play between the base plates 7 of the slabs 1 is preserved and even accentuated by the elasticity of the bonding between the slabs and their supports, thus making it possible to offset all the problems of expansion. Obviously, the play between the base surfaces 7 of the adjacent slabs 1 obtained by adding a boss on the elastic strips 10 could equally well be achieved with another device, for example through folding the strips 10, but in this case, a regular distribution of the play between the base surfaces 7 would be harder to achieve than with bosses.

FIG. 13 shows a raised floor according to the invention consisting of a set of horizontal modular slabs 1, which are attached to each other and are of the same size and the same equilateral triangle shape. The tops of the individual slabs 1 are merged in points O constituting the nodes of a mesh network with triangular meshes formed by the set of slabs 1.

Each node O of the network constitutes the common top of six triangular slabs 1 distributed regularly around a vertical axis passing through the node O and constituting at the same time a regular hexagon. A subjacent support 2 is associated to each node O, which said subjacent support will be described in detail below. The support may consist of an independent element, for example such as one of the element 16, 21, 25, 29, or 31 illustrated in FIGS. 21 to 27. At its lower end, the support 2 rests on the ground on which the raised floor is mounted. From the preceding description it may therefore be seen that each triangular slab 1 rests on the floor at the three points O formed by the three tops of the equilateral triangle constituted by said slab.

The triangular-shaped modular slabs 1 are only used if the length L of the surface to be covered by the raised floor is equal to a multiple of the height h of each triangular slab 1.

However, as may be required in exceptional circumstances, provision is made, again according to the invention, to complete the assembly of the raised floor, in the neighborhood of the walls, by means of supplementary end slabs 14 , each in the form of an isosceles trapezium corresponding to three attached standard main triangular slabs 1. In other words, the small base of each end slab 14 is equal in length to the side of the triangular slab 1, the length of its large base is equal to twice the length of the side of a triangular slab 1, and the height of an end trapezoid slab 14 is equal to the height h of a triangular slab 1. The median area of the large base of each end slab 14 is arranged so as to be capable of receiving a standard support or a standard jack, as will be seen below.

The end slabs 14 ensure good floor stability along the walls, once adjusting cuts have been made. FIG. 14 shows various scenarios explaining this necessity.

The section carried out in the direction of arrow a reveals that the triangular main slabs 1 give satisfactory results, that is to say an adequate support along length a1. Lengths a2 and a3 show three other adjustment possibilities by means of end slabs 14 which are truncated in order to obtain improved results.

The section carried out in the direction of arrow b shows that the small surfaces x of the triangular slabs 1, remaining after cutting and indicated by section lining, are inadequate and unequal to the task of providing satisfactory support along length b1. In contrast, end slabs 14 are used along length b2, and the parts remaining after cutting, represented in section lining, have a sufficient surface to provide a satisfactory support.

The section carried out in the direction of arrow c shows that satisfactory stability is obtained, along length c1, using the end slabs 14, but in this case triangular slabs 1 could also have been used.

The section carried out in the direction of arrow d reveals that satisfactory stability along length d1 is obtained using cut end slabs 14, whereas the triangular slabs 1 would involve small cuts x which would be impossible to fix.

In the angles, the sectional intersections—in directions a and c, on the one hand, and in directions b and d, on the other hand—are made using end slabs 14.

FIGS. 14, 15, 16, 17 and 18 represent the triangular-shaped slabs corresponding to the variant of the invention under consideration. The characteristics are the same as for modular slabs of any regular polygonal shape. The subjacent support 2 comprises an upper support face 5 in which six converging radial slots are bored, these slots being distributed at regular intervals and at an angle of 60° to each other, on a circle of center O where the tops of six adjacent triangular slabs 1 are merged, as shown in FIG. 16. If the support face 5 is circular, it may be seen that each corner of a triangular slab 1 rests on a sector at an angle of 60° of the circular support face 5. Parts 3 of edges 6, folded downwards, are inserted in the converging radial slots 4. As the width e of each slot 4 is chosen equal to twice the thickness of the parts 3 of the edges 6, said edges 6 of two adjacent triangular slabs 1 are packed and blocked against each other in the same slot 4, as may be seen from a study of FIGS. 17 and 18, thereby ensuring a firm fixture of the slabs 1 on the support 2. The converging forms of the slots 4 provide the horizontal hold of the slabs 1, while the three-point support for each slab 1 gives perfect stability, thus eliminating any risk of vertical movement which might lead to disassembly, but at the same time ensuring easy, fast and effortless dismantling. Moreover, each support 2 is particularly stable since it is simultaneously retained by six adjacent triangular slabs 1.

With a view to making the representation as clear as possible, in FIGS. 14, 15, 16, 17 and 18 the edges 6 are shown in their simplest form, that is to say without height reduction at their extremities, without strips and without bosses. It is clear that all these different variants may be applied to triangular-shaped slabs. In particular, in the presence of bosses 13 on the elastic strips 10, the width of the radial slots 4 will be equal to twice the thickness of the strips 10 plus once the thickness of the boss 13.

The view from below represented in FIG. 18 gives a good illustration of the way in which the edges 6 of triangular slabs 1 are attached to each other, thereby establishing the continuity of the floor. However, due to the fact that there is a separation plane between two adjacent slabs 1, the floor displays good acoustic performance since the separation planes between the slabs break horizontal sound transmission, particularly in the case of the variant in which parts 3 of edges 6 are in the shape of elastic strips fitted with bosses, because in this case the base plates 7 of the slabs are separated from each other by a play corresponding to the thickness of the boss. Moreover, given that the triangular slabs 1 are small in size, they mitigate the membrane effect obtained with larger surfaces.

FIGS. 19 and 20 represent an arrangement of a trapezoid end slab 14. This end slab may also, like the triangular slab 1, be made up of sheet metal cut and folded so as to form a trapezoid base plate 35 which presents, on its sides, rims folded at right angles in the same direction and culminating at a same distance from the tops of the base plate 35. The two inclined sides and the small base of the trapezoid slab 35 each comprise two distinct edges 15 which are obtained by creating a recess 34 centered on the edge of the large base. This recess 34 between the two edges 15 of the large base is needed to attach the end slab 14 to the subjacent supports.

With reference to FIGS. 21 to 27, a description will now be given of various non limitative embodiments of the floor supports. These supports, which are constituted by independent elements designed to receive, according to a preferred variant of the considered invention, on their upper faces, the triangular slabs 1 and the trapezoid end slabs 14 and to keep them assembled, determine the height of the plenum obtained, that is to say, of the empty space under the floor which is equal to their own height. Each support comprises a horizontal upper face 5 in which are formed the six converging radial slots 4 distributed, at an angle of 60° in relation to each other, around the center O of the upper face 5.

The support 16 represented in FIG. 21, is made in a single steel piece, in a general upwardly converging tapered shape, terminated at its lower part by an external flange 17 constituting a support base on the ground. The upper face of the upper horizontal wall 18 of the support 16 constitutes in itself the planar support and fastening face 5 of the slabs. The radial slots 4 are bored both in the upper wall 18 and in the upper part of the tapered lateral wall.

In the variant represented in FIG. 22, the support 16 comprises a full upper wall 20 onto which is fastened, for example by welding, an added circular plate 19 in which the radial slots 4 are formed.

In the variant represented in FIG. 23, the support 21 is made up of three parts, assembled together by welding or otherwise, namely a lower horizontal base 22, an upper horizontal head 23 in which the radial slots 4 are bored in order to fasten the slabs, and an intermediate vertical body 24 stretching between the base 22 and the head 23, all these elements being preferably fabricated in steel.

In the variant represented in FIG. 24, the support 25 comprises a lower block 26, of tapered shape and possibly made of matter which is inert to fire such as resin, plastic matter, plaster, cement, anhydrites, calcium silicate, conglomerate wood, etc. An upper circular steel plate 27 is fixed on the upper face of block 26, in which said plate 27 are cut the radial slots 4 which lie above corresponding radial grooves 28 formed on the upper part of block 26.

In the variant represented in FIG. 25, the support 29 is made up of a molded block, with a grooved structure, and fabricated of light alloy, plastic material, compressed wood, resin, etc. The support 29, of a general taper shape, possesses in its upper horizontal wall six molded radial grooves 30 placed at an angle of 60° in relation to each other as described in the previous embodiments.

Figure 26:
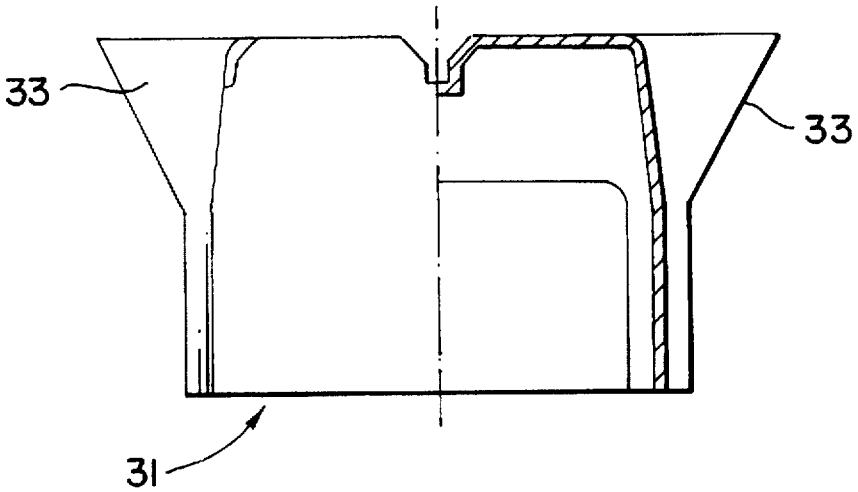
Figure 27:
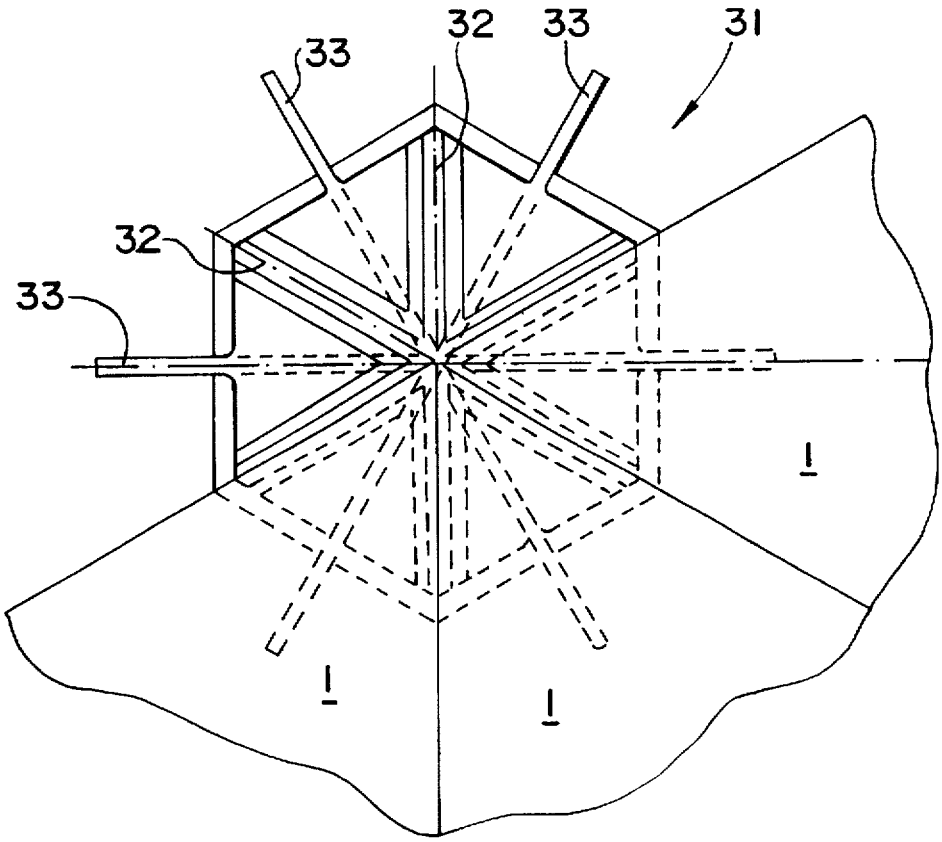
FIG. 27 is an overhead view of the variant embodiment of the support presented in FIG. 26.

FIGS. 26 and 27 show a variant in which the support 31 is made up of a hexagonal shape in molded material hollowed out by six radial slots 32 and equipped with six reinforcement grooves 33 shifted by 30° compared to the radial slots, these reinforcement slots 33 making it possible both to increase the ground support surface and the slab support surface.

What is claimed is:

1. A raised floor comprising:

a plurality of modular slabs, each of said modular slabs having a regular polygonal shape with a plurality of sides, and a surface of the raised floor being exclusively formed of said plurality of modular slabs arranged adjacent to each other;

each of said modular slabs having a respective plate portion, forming a substantially horizontal base surface, and a plurality of substantially vertical edges extending substantially perpendicularly from said base surface;

a plurality of substantially vertically extending supports, each of said supports comprising an upper head extending substantially horizontally and forming a periphery, said upper heads supporting said base surfaces of said modular slabs;

said upper heads having a plurality of radially extending slots terminating at said respective peripheries of said upper heads; and said modular slabs being arranged so that respective pairs of edges of abutting slabs face against each other and at least a predetermined portion of each of said pairs of edges are tightly fitted into a respective radially extending slot of one of said plurality of supports, said predetermined portion of each of said pairs of edges which are tightly fitted into a radial slot of a support comprises a radially extending elastic strip formed by a horizontal cut in each edge of said pair of edges.

2. A raised floor according to claim 1, wherein:

each edge of said pairs of edges have two of said radial elastic strips oppositely positioned along each said edge, only one of said two oppositely positioned radial elastic strips of each edge having a boss fitted thereto; and said bosses are superimposable from one slab to another and being invariant by rotation of order n, n being the number of said sides of said slab.

3. A raised floor according to claim 1, wherein:

each said edge extends substantially horizontally over a length less than a length of a side of a respective slab, each said edge being centered at a middle of the side.

4. A raised floor according to claim 3, wherein:

each of said slots of said upper heads of said supports includes a depth, defined by a bottom, so that said edges do not contact said bottoms of said slots.

5. A raised floor according to claim 1, wherein:

said modular slabs have an equilateral triangular shape arranged with respective vertices merging toward a common point; and said radially extending slots of said upper head of each of said supports, supporting adjacent triangular slabs beneath said common point, are six in number, said six slots converging toward said common point and being distributed at an angle of 60° in relation to each other.

6. A raised floor according to claim 1, wherein:

each of said supports is comprised of a single unitary piece, having an upwardly tapered part, said support having a lower part formed as an external flange for engagement with the ground and an upper part formed as a substantially horizontal wall.

7. A raised floor according to claim 6, wherein:

said radial slots are formed in said upper horizontal wall and extend to an upper portion of said upwardly tapered part.

8. A raised floor according to claim 6, further comprising:

a circular plate affixed atop said upper part, said radial slots being formed in said circular plate.

9. A raised floor according to claim 1, wherein:

each of said supports is comprised of three parts assembled together, including a lower substantially horizontal base, an upper substantially horizontal head, and a substantially vertical intermediate body extending between said lower base and said upper head, said radial slots being formed in said upper head.

10. A raised floor according to claim 1, wherein:

each of said supports is comprised of a lower block having a tapered form, and a circular plate affixed atop said lower block;

said lower block have an upper face with radial grooves therein; and said radial slots are formed in said circular plate and lie above corresponding ones of said radial grooves of said upper face of said lower block.

11. A raised floor according to claim 1, wherein:

each of said supports is comprised of a molded unitary block having a tapered form and an upper substantially horizontal wall; and said radial slots are formed by having been molded into said upper wall at regular intervals in relation to each other.

12. A raised floor according to claim 1, wherein:

said slabs are made of cut and bent sheet metal, said edges of said slabs being formed by having been bent at substantially right angles in relation to said plate portions of said slabs.

13. A raised floor according to claim 1, wherein:

said modular slabs have a rectangular shape.

14. A raised floor comprising:

a plurality of modular slabs, each of said modular slabs having a regular polygonal shape with a plurality of sides, and a surface of the raised floor being exclusively formed of said plurality of modular slabs arranged adjacent to each other;

each of said modular slabs having a respective plate portion, forming a substantially horizontal base surface, and a plurality of substantially vertical edges extending substantially perpendicularly from said base surface;

a plurality of substantially vertically extending supports, each of said supports comprising an upper head extending substantially horizontally and forming a periphery, said upper heads supporting said base surfaces of said modular slabs;

said upper heads having a plurality of radially extending slots terminating at said respective peripheries of said upper heads;

said modular slabs being arranged so that respective pairs of edges of abutting slabs face against each other and at least a predetermined portion of each of said pairs of edges are tightly fitted into a respective radially extending slot of one of said plurality of supports, said predetermined portion of each of said pairs of edges which are tightly fitted into a radial slot of a support comprises a radially extending elastic strip formed by a cut in each edge of said pair of edges;

said modular slabs having an equilateral triangular shape arranged with respective vertices merging toward a common point;

said radially extending slots of said upper head of each of said supports, supporting adjacent triangular slabs beneath said common point, are six in number, said six slots converging toward said common point and being distributed at an angle of 60° in relation to each other;

said raised floor further comprising end slabs, each said end slab having the form of an isosceles trapezium corresponding to three attached triangular slabs, said isosceles trapezium having a small base, a large base and a height, said small base having a length equal to a side of one of said triangular slabs, said large base having a length equal to twice the side of one of said triangular slabs, and said height equal to a height of one of said triangular slabs.

15. A raised floor according to claim 14, wherein:

said predetermined portion of each of said pairs of edges which are tightly fitted into a radial slot of a support comprises a radially extending elastic strip formed by a vertical cut in each edge of said pair of edges.

16. A raised floor according to claim 14, wherein:

said isosceles trapezium has a pair of opposed inclined sides;

each of said inclined sides and said small base has one of said vertical edges; and said large base has two distinct edges separated by means of a recess.

17. A raised floor according to claim 14, wherein:

said triangular slabs and said trapezoidal end slabs are made of cut and bent sheet metal, said edges of said slabs being formed by having been bent at substantially right angles in relation to said plate portions of said slabs.

18. A raised floor according to claim 14, wherein:

said predetermined portion of each of said pairs of edges which are tightly fitted into a radial slot of a support comprises a radially extending elastic strip formed by a horizontal cut in each edge of said pair of edges.

19. A raised floor comprising:

a plurality of modular slabs, each of said modular slabs having a regular polygonal shape with a plurality of sides, and a surface of the raised floor being exclusively formed of said plurality of modular slabs arranged adjacent to each other;

each of said modular slabs having a respective plate portion, forming a substantially horizontal base surface, and a plurality of substantially vertical edges extending substantially perpendicularly from said base surface;

a plurality of substantially vertically extending supports, each of said supports comprising an upper head extending substantially horizontally and forming a periphery, said upper heads supporting said base surfaces of said modular slabs;

said upper heads having a plurality of radially extending slots terminating at said respective peripheries of said upper heads; and said modular slabs being arranged so that respective pairs of edges of abutting slabs face against each other and at least a predetermined portion of each of said pairs of edges are tightly fitted into a respective radially extending slot of one of said plurality of supports, said predetermined portion of each of said pairs of edges which are tightly fitted into a radial slot of a support comprises a radially extending elastic strip formed by a vertical cut in each edge of said pair of edges;

wherein each edge of said pairs of edges have two of said radial elastic strips oppositely positioned along each said edge, only one of said two oppositely positioned radial elastic strips of each edge having a boss fitted thereto; and wherein said bosses are superimposable from one slab to another and being invariant by rotation of order n, n being the number of said sides of said slab.

20. A raised floor comprising:

a plurality of modular slabs each of said modular slabs having a regular polygonal shape with a plurality of sides, and a surface of the raised floor being exclusively formed of said plurality of modular slabs arranged adjacent to each other;

each of said modular slabs having a respective plate portion, forming a substantially horizontal base surface, and a plurality of substantially vertical edges extending substantially perpendicularly from said base surface;

a plurality of substantially vertically extending supports, each of said supports comprising an upper head extending substantially horizontally and forming a periphery, said upper heads supporting said base surfaces of said modular slabs;

said upper heads having a plurality of radially extending slots terminating at said respective peripheries of said upper heads; and said modular slabs being arranged so that respective pairs of edges of abutting slabs face against each other and at least a predetermined portion of each of said pairs of edges are tightly fitted into a respective radially extending slot of one of said plurality of supports, said predetermined portion of each of said pairs of edges which are tightly fitted into a radial slot of a support comprises a radially extending elastic strip formed by a cut in each of said pair of edges, wherein each of said predetermined portions of each edge of said pairs of edges has a reduced height in relation to a height of a remainder portion of the edge and each of said slots of said upper heads of said supports have a depth greater than said reduced height.

21. A raised floor comprising:

a plurality of modular slabs, each of said modular slabs having a regular polygonal shape with a plurality of sides, and a surface of the raised floor being exclusively formed of said plurality of modular slabs arranged adjacent to each other;

each of said modular slabs having a respective plate portion, forming a substantially horizontal base surface, and a plurality of substantially vertical edges extending substantially perpendicularly from said base surface;

a plurality of substantially vertically extending supports, each of said supports comprising an upper head extending substantially horizontally and forming a periphery, said upper heads supporting said base surfaces of said modular slabs;

said upper heads having a plurality of radially extending slots terminating at said respective peripheries of said upper heads;

said modular slabs being arranged so that respective pairs of edges of abutting slabs face against each other and at least a predetermined portion of each of said pairs of edges are tightly fitted into a respective radially extending slot of one of said plurality of supports, said predetermined portion of each of said pairs of edges which are tightly fitted into a radial slot of a support comprises a radially extending elastic strip formed by a cut in each edge of said pair of edges;

said modular slabs having an equilateral triangular shape arranged with respective vertices merging toward a common point;

said radially extending slots of said upper head of each of said supports, supporting adjacent triangular slabs beneath said common point, are six in number, said six slots converging toward said common point and being distributed at an angle of 60° in relation to each other each of said supports being a unitary piece having a generally hexagonal shape in top plan view, said radial slots being formed in an upper part of each said support at regular intervals in relation to each other, each said support further having reinforcing ribs extending outwardly from said hexagonal shape positioned at regular intervals in relation to said radial slots.

* * * * *